United States Patent [19]

Klapdar et al.

[11] 4,036,635

[45] July 19, 1977

[54] PROCESS FOR MAKING A STEEL MELT FOR CONTINUOUS CASTING

[75] Inventors: Wilhelm Klapdar, Essen; Helmut Richter, Oberhausen; Edgar Spetzler, Oberhausen; Jochen Wendorff, Oberhausen, all of Germany

[73] Assignee: Thyssen Niederrhein AG Hutten- und Walzwerke, Oberhausen, Germany

[21] Appl. No.: 697,225

[22] Filed: June 17, 1976

[30] Foreign Application Priority Data

June 18, 1975 Germany ..... 2527156

[51] Int. Cl.[2] ..... C21C 7/06; C21C 7/10

[52] U.S. Cl. ..... 75/49; 75/51; 75/58

[58] Field of Search ..... 75/51-60, 75/46, 61

[56] References Cited

U.S. PATENT DOCUMENTS 3,099,552 7/1963 Landig ..... 75/51

3,885,957 5/1975 Richter ..... 75/58

*Primary Examiner*—Peter D. Rosenberg

*Attorney, Agent, or Firm*—Karl F. Ross; Herbert Dubno

[57] ABSTRACT

A process for making a steel melt for continuous casting in which the steel melt is formed in a smelting unit under an iron-oxide-containing slag which is held back while the steel melt is tapped and subjected to deoxidation with silicon or aluminum. The sulfur-containing deoxidized melt is then subjected to an aftertreatment with a calcium-containing substance, especially calcium-silicon or calcium carbide in a covered ladle with a silica-free lining after the steel melt is covered with a synthetic slag formed from pulverulent lime and 10 to 30% of a silica-free fluorite and/or alumina fluxing agent which does not release oxygen to the melt. The calcium-containing substance is introduced in an amount which is greater than that required for desulfurization and/or establishing the viscosity of the melt, at a depth of at least 2000 mm and about 300 mm above the bottom of the ladle in a neutral carrier gas (e.g. argon).

11 Claims, 1 Drawing Figure

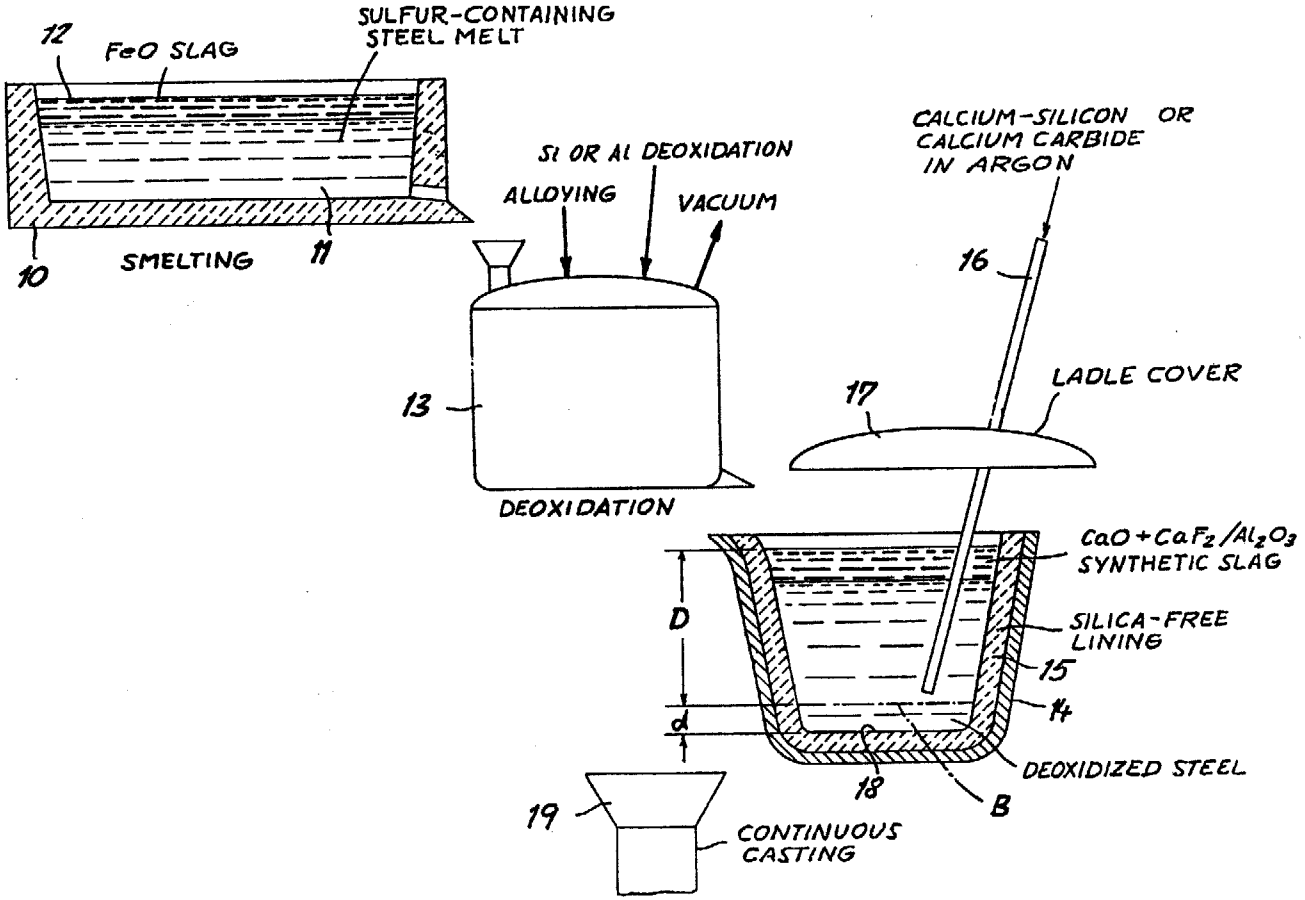
SULFUR-CONTAINING STEEL MELT
FeO SLAG
12
10
11
SMELTING
Si OR Al DEOXIDATION
ALLOYING
VACUUM
13
DEOXIDATION
CALCIUM-SILICON OR CALCIUM CARBIDE IN ARGON
16
LADLE COVER
17
CaO + CaF2/Al2O3 SYNTHETIC SLAG
SILICA-FREE LINING
15
14
DEOXIDIZED STEEL
B
18
D
d
CONTINUOUS CASTING
19

PROCESS FOR MAKING A STEEL MELT FOR CONTINUOUS CASTING

FIELD OF THE INVENTION

The present invention relates to a process for producing a steel melt for continuous casting and, more particularly, to a process for lowering the oxygen and sulfur content of a steel melt for use in continuous casting.

BACKGROUND OF THE INVENTION

It is known in connection with continuous casting processes that numerous defects arise in the cast billets, blooms or ingots, particularly in the form of segregation cracks, core segregations and inclusions of nonmetallic substances. Because of the differences in the cooling conditions during continuous casting and ordinary casting, such defects have been found to be particularly significant in continuous casting billets.

Attempts have been made to reduce the defects of continuous casting by optimally adjusting and maintaining the casting temperature, the casting speed and cooling intensity for the continuously cast strand. This has been found to be a difficult procedure.

The predominant defect in continuous casting is that which is brought about by segregations or oxidic inclusions. The segregating elements tend to be enriched in the melt above the solidifying casting and are eventually entrained in the form of nonmetallic inclusions as solidification proceeds. It has been found that segregation and oxidic inclusion defects are a function of the residual oxygen and sulfur contents of the melt. Enrichment of such elements tends to occur in the core of the continuous casting, resulting in an increase in the formation of oxides, sulfides, gas-bubble spaces and a globulitic solidification structure. These all are associated with core segregation.

The invention is based upon the principle that it is possible to avoid such defects by providing a casting melt which contains practically no solubilized oxygen and no sulfur.

It has been found that prior-art techniques for the reduction of the oxygen and sulfur levels in a steel melt are not satisfactory in reducing the concentrations of these elements to the desired low level.

For example, it has been proposed to produce a steel melt with an extremely low sulfur content using techniques which involve the addition of cerium mix metal (misch metal) having a high affinity for sulfur or by blowing calcium components into the steel melt.

It is also known to reduce the oxygen content of a steel melt by introducing compounds or elements with a high oxygen affinity into the melt. Such substances are, for example, silicon and aluminum.

Both techniques have been found to have certain disadvantages. For example, when silicon is introduced into the melt it is not possible to lower the oxygen level sufficiently, presumably because silicon does not have a sufficient affinity for oxygen. The use of a stronger deoxidizing medium such as aluminum has the disadvantage that a portion of the reaction product, namely aluminum oxide, does not separate from the melt but remains dispersed in the liquid phase and is entrained therewith into the casting. Electrochemical techniques have shown that oxygen does not react with aluminum completely when it is used as the deoxidizing agent. Thus, in order to reduce the oxygen level sufficiently, it is necessary to use 10 to 15 times as much aluminum as is theoretically necessary to combine with all of the oxygen. Very low residual oxygen contents, e.g. below 10 parts per million, can thus only be achieved with extremely high aluminum quantities or by the addition of still more effective deoxidizing agents such as cerium mix metal.

The latter technique, however, gives rise to a problem which has long been recognized and feared in the art, namely, the reaction of the excess deoxidizing agent (aluminum or cerium) during the casting with the refractory lining of the casting system and especially the silica thereof. This reaction produces additional oxides which eventually are incorporated in the steel melt and are found in the casting. Furthermore, the suspended oxide aggregates in the melt increase the viscosity thereof so that higher melt temperatures must be used to cast the steel.

In continuous casting, an increase of the casting temperature has significant disadvantages, e.g. greater wear of the casting system, less effective cooling and solidification, etc. Furthermore, the oxide aggregates can deposit on the wall of the casting system, can create blockages, and can be incorporated in the casting both along the periphery and within the interior thereof.

It has been found to be necessary, in such cases to machine the surfaces of the cast ingot or billet at considerable cost and with significant losses of material.

Efforts have also been made to remove the detrimental alumina particles from the steel band. For example, German published application (Offenlegungsschrift) No. 2,304,943 teaches the introduction of a lance or the like into the melt so as to induce the oxide which would be entrained into the continuous casting strand to rise to the casting slag covering the melt. Another proposal (German published application - Offenlegungsschrift - No. 2,300,963) induces the deposition of the alumina aggregates on a lattice-like arrangement of refractory ceramic material.

In German published application (Offenlegungsschrift) No. 2,312,137, the oxides suspended in the melt are induced to flow in a given manner and to separate from the steel. German published application (Offenlegungsschrift) No. 2,219,818 suggests that the problem can be eliminated by separating the oxides from the melt by the use of a jet of a purifying gas.

Finally, there may be mentioned a number of other techniques which have been proposed in order to avoid entrainment of the alumina aggregates into the melt, namely, the flushing of the melt with inert gas, the treatment of a melt in a vacuum or either of these techniques in combination with the purification or refining approaches mentioned above. All of these techniques have been found to have various disadvantages or involve prohibitive costs. Frequently they require increasing the casting temperature, etc.

The above-mentioned enumeration of techniques which have been used to solve this problem demonstrates that the art has not yet been able to produce a melt for continuous casting in an inexpensive, efficient and problem-free manner.

OBJECTS OF THE INVENTION

It is an object of the invention to provide an improved process for making a melt for continuous casting.

SUMMARY OF THE INVENTION

These objects and others which will become apparent hereinafter are attained, in accordance with the present invention, in a method of producing a steel melt for continuous casting in which a sulfur-containing melt is produced in a smelting unit and is tapped therefrom while retaining the slag formed during smelting. This slag is rich in iron oxide. According to the invention, the slag-free melt is then subjected to deoxidation by the addition of silicon an/or aluminum, may be augmented with alloying elements and can be subjected to a vacuum treatment.

According to the invention, the sulfur-containing deoxidized melt is then treated with a calcium-containing treating agent (especially calcium-cilicon or calcium carbide) in a covered ladle having a silica-free, preferably dolomite, lining after covering the steel melt with pulverulent lime and 10 - 30% by weight of a silica-free fluxing agent which does not release oxygen to the melt. The fluxing agent is preferably fluorite (calcium fluoride) and/or aluminum. The lime and the fluorite and/or aluminum form a liquid synthetic slag which overlies the steel melt. The calcium carrier is introduced into the melt in an amount in excess of the calcium required for desulfurization and/or in excess of the amount normally required for adjusting the viscosity of the melt by blowing the calcium-containing treating agent in finely divided form into the steel melt at a depth of at least 2000 mm below the surface of the melt and approximately 300 mm above the bottom of the ladle in a neutral carrier gas (e.g. argon).

The basic steps of the invention involve certain critical aspects. For example, it is essential that the melt be covered, i.e. that the ladle be provided with a cover, according to the invention in order to prevent access of the surface of the melt to atmospheric oxygen or to limit the availability of atmospheric oxygen to the surface of the melt.

It has also been found to be critical that the calcium treating agent is provided in substantial excess over that which is required to stoichiometrically react with all of the sulfur of the melt and is fed into the melt at a rate which is less than that at which the sulfur is capable of reacting with the calcium of this treating agent.

The depth to which the calcium-containing treating agent is introduced into the melt, i.e. a minimum depth of 2000 mm and preferably a depth of 2700 mm, has also been found to be critical for effective interaction between the treating agent and the melt.

The process of the present invention has been found to be capable of reducing the sulfur content to a minimum of 0.005% by weight and to improve the viscosity characteristic of the steel melt as well as the ductility of the cast product. The latter improvement is especially significant when the continuously cast billet is to be used for rolling.

It has been found, quite surprisingly, that the so-called "overblowing" of the melt with the calcium-containing treating agent can readily lower the sulfur content to less than 0.003% sulfur, eliminates the blocking of the casting outlet during continuous casting with a temperature of only 10° C above the melting point or less.

Of equal or perhaps greater importance is the fact that neigher the surface of the continuous casting nor the interior thereof is found to contain oxidic inclusions. Lattice inhomogeneities such as segregations, segregation cracks, core segregation and internal porosity are all eliminated.

Similar results are not obtained when the sequence of steps given above is not followed, when less calcium is used or where elemental calcium serves as the treating agent.

Preferably, the calcium-containing treating agent is used in an amount of 1 to 1.8 kg of calcium per ton, preferably 1.2 kg of calcium per ton. The calcium-containing treating agent is introduced via a lance into the band at a depth in excess of 2 m, preferably in excess of 2.7 m, over a period of 5 to 10 minutes while the ladle is covered to prevent or reduce access of the surface of the melt to atmospheric oxygen. It is essential for the invention, moreover, that the ladle have a silica-free lining (e.g. MgO, $Al_2O_3$ or dolomite).

Because of the relatively large specific surface area of the emulsion-size droplets of calcium and the long residence time of the calcium droplets in the melt, a portion of the calcium is solubilized in the melt while the remainder reacts with sulfur and any alumina inclusions formed during the deoxidation step. The unconsumed portion of the calcium droplets rises in the melt and evaporates as soon as the pressure head so permits. The calcium vapors can pass from the melt and fill any space between the cover and the surface thereof. Practically all alumina in the melt is, because of the high oxygen affinity of the calcium, reduced to calcium oxide which migrates to the synthetic slag.

The aforementioned results are indeed surprising. In conventional processes in which desulfurization is carried out by calcium, the reaction between calcium and alumina in the melt has been found to produce only calcium aluminate while the process of the present invention results in a complete conversion of the alumina to calcium oxide. The resulting calcium oxide particles are fully released from the melt into the overlying synthetic slag. Thus, while the prior-art systems resulted in calcium-oxide alumina (calcium aluminate) inclusions in the melt, the steels produced in accordance with the present invention contain neither alumina nor calcium oxide. The aluminum which is released by the reaction of the calcium with the alumina, of course, is dispersed in the melt and serves to improve the rolling qualities thereof. A disproportionately high metallic calcium content can also be found in the melt.

Furthermore, one would ordinarily expect the proportionately high level of metallic calcium in the melt and the high oxygen affinity of calcium to bring about a deterioration of the refractory materials in the casting system or deposition of reaction products on the immersion tubes. Surprisingly, however, this does not occur and the immersion tubes are found to be completely free from any deposits. The continuously cast product is also free from reaction products of calcium and the lining materials and this is indicative of the fact that substantially no reaction between the calcium of the melt and the walls of the casting system occurs. While the reason for this surprising phenomenon has not been determined with certainty, it is believed that the calcium in the melt may form a stable surface layer upon the refractory material of the casting system and thus prevent a re-oxidation of the melt so that the defects of conventional aluminum-containing continuous steel castings are completely excluded.

BRIEF DESCRIPTION OF THE DRAWING

The above and other objects, features and advantages of the present invention will become more readily apparent from the following description, reference being made to the sole FIGURE of the accompanying drawing which diagrammatically illustrates a system for continuous casting according to the invention.

SPECIFIC DESCRIPTION

In the drawing there has been shown a smelting unit 10, operating in the conventional manner, and containing a high-sulfur steel melt 11 which is overlain by an iron-oxide-containing slag 12. The steel melt is tapped from the smelting unit 10 into a vacuum treatment vessel 13 which can also be of conventional construction while the slag 12 is held back in the smelting unit 10. Alloying substances can be added to the melt in the vacuum treatment vessel 13 and silicon and/or aluminum is introduced in order to carry out the deoxidation. Thereafter, the deoxidized steel melt is tapped into a ladle 14 provided with a silica-free lining 15 (e.g. of dolomite) and is covered with pulverulent lime and fluorite and/or alumina to form a synthetic slag. The cover 17 can then be placed on the ladle and the lance 16 immersed into the bath to a depth B which is at a distance D below the surface of the melt of at least 2000 mm and preferably at least 2700 mm. The location B at which the calcium-containing treating agent is introduced into the melt is at a distance *d* of about 300 mm above the bottom 18 thereof. Calcium-silicon or calcium-carbide powder in an argon carrier gas is blown into the melt through the lance 16. When the treatment is terminated, the slag can be poured off and the melt fed to the continuous casting unit 19. Alternatively, a siphon tube can be used to transfer the treated steel melt to the continuous casting unit 19 in a conventional manner.

SPECIFIC EXAMPLE

120 Tons of a nondeoxidized steel is prepared in a smelting furnace under a limestone-silica slag and has a composition by weight of:

0.17% carbon
0.01% silicon
0.012% phosphorus
0.017% sulfur
0.006% nitrogen
0.12% oxygen (as oxides and as dissolved)
balance iron.

The melt was tapped into a deoxidization ladle while the iron oxide slag was retained in the smelting furnace and was deoxidized with aluminum over a period of five minutes and until the composition was by weight:

0.17% carbon
0.05% silicon
0.12% phosphorus
0.017% sulfur
0.04% aluminum
traces nitrogen
balance iron.

Manganese was added as an allying ingredient to a concentration of 1.45% by weight.

The deoxidized melt was then treated in a closed ladle having a silica-free dolomite lining after covering the melt with 360 kg of a powdered lime and 90 kg of calcium fluoride to form a synthetic slag.

Using a lance, 1.2 kg of calcium per ton of the melt, as pulverulent calcium-silicon, was blown into the melt in argon at a depth of 2.7 m and 300 mm above the bottom of the ladle over a period of eight minutes.

The composition was then found to be by weight:

0.17% carbon
0.40% silicon
0.11% phosphorus
0.003% sulfur
0.04% aluminum
traces calcium
1.45% manganese
balance iron.

The melt was continuously cast and produced a billet which rolled readily and was free from oxide or sulfide inclusions, segregations and both interior and surface defects. When an open ladle was used, when less than 1 kg per ton of calcium was used, when the depth was less than 2000 mm, and then when a siliceous lining or slag was employed, some segregations were always present.

We claim:

1. A process for producing a steel melt for continuous casting comprising the steps of:

a. forming a sulfur-containing steel melt below an iron-oxide-containing slag in a smelter vessel;
b. discharging said sulfur-containing steel melt from said vessel while retaining said slag therein;
c. deoxidizing said sulfur-containing steel melt discharged in step b. from said vessel in a ladle by adding at least one substance selected from the group which consists of silicon and aluminum thereto to produce a deoxidized sulfur-containing steel melt;
d. introducing said deoxidized sulfur-containing steel melt into a covered ladle and forming above said deoxidized sulfur-containing steel melt in said covered ladle a synthetic slag which consists of pulverulent lime and 10 to 30% of a silica-free fluxing agent; and
e. blowing into said deoxidized sulfur-containing melt in said covered ladle at a depth of at least 2000 mm and about 300 mm above the bottom of said covered ladle in a neutral carrier gas a finely divided calcium-containing substance in a quantity in excess of a quantity of calcium required to stoichiometrically react with the sulfur of said deoxidized sulfur-containing melt, said covered ladle having a silica-free lining.

2. The process defined in claim 1 wherein said calcium-containing substance is introduced into said melt in an amount in excess of the stoichiometric requirements for reaction with all of the sulfur and any compound selected from the group which consists of alumina and silica in said deoxidized sulfur-containing melt.

3. The process defined in claim 1 wherein said calcium-containing substance is selected from the group which consists of calcium-silicon and calcium carbide.

4. The process defined in claim 1 wherein said fluxing agent is selected from the group which consists of fluorite and alumina.

5. The process defined in claim 1 wherein said calcium-containing substance is introduced in an amount sufficient to reduce the sulfur content of the melt below 0.005 percent.

6. The process defined in claim 1 wherein the calcium-containing substance is introduced in an amount of 1 to 1.8 kg of calcium per ton of the deoxidized sulfur-containing steel melt.

7. The process defined in claim 6 wherein said calcium-containing substance is introduced in an amount corresponding to 1.2 kg of calcium per ton of the deoxidized sulfur-containing steel melt.

8. The process defined in claim 7 wherein the calcium-containing substance is blown into said deoxidized sulfur-containing melt at a depth in excess of 2.7 m.

9. The process defined in claim 8 wherein the calcium-containing substance is blown into said deoxidized sulfur-containing melt over a period of 5 to 10 minutes.

10. A process for producing a casting which comprises the steps of:

a. forming a sulfur-containing steel melt below an iron-oxide-containing slag in a smelter vessel;

b. discharging said sulfur-containing steel melt from said vessel while retaining said slag therein;

c. deoxidizing said sulfur-containing steel melt discharged in step (b) from said vessel in a ladle by adding at least one substance selected from the group which consists of silicon and aluminum thereto to produce a deoxidized sulfur-containing steel melt;

d. introducing said deoxidized sulfur-containing steel melt into a covered ladle and forming above said deoxidized sulfur-containing steel melt in said covered ladle a synthetic slag which consists of pulverulent lime and 10 to 30% of a silica-free fluxing agent;

e. blowing into said deoxidized sulfur-containing melt in said covered ladle at a depth of at least 2000 mm and about 300 mm above the bottom of said covered ladle in a neutral carrier gas a finely divided calcium-containing compound in a quantity in excess of the quantity of calcium required to stoichiometrically react with the sulfur of said deoxidized sulfur-containing melt, said covered ladle having a silica-free lining; and f. continuously casting the melt formed by blowing said calcium-containing compound into said deoxidized sulfur-containing melt.

11. The process defined in claim 10, further comprising the step of vacuum-treating the deoxidized sulfur-containing melt prior to blowing said calcium-containing compound therein.

* * * * *